US012016429B2

(12) United States Patent
Alviani

(10) Patent No.: US 12,016,429 B2
(45) **Date of Patent: *Jun. 25, 2024**

(54) INTERCHANGEABLE HEEL DEVICE FOR A SHOE AND METHOD

(71) Applicant: Alice G. Alviani, Waukegan, IL (US)

(72) Inventor: Alice G. Alviani, Waukegan, IL (US)

( * ) Notice: Subject to any disclaimer, the term of this patent is extended or adjusted under 35 U.S.C. 154(b) by 6 days.

This patent is subject to a terminal disclaimer.

(21) Appl. No.: 17/922,356

(22) PCT Filed: Apr. 30, 2021

(86) PCT No.: PCT/US2021/030273

§ 371 (c)(1),
(2) Date: Oct. 29, 2022

(87) PCT Pub. No.: WO2021/222812

PCT Pub. Date: Nov. 4, 2021

(65) Prior Publication Data

US 2023/0138799 A1 May 4, 2023

(51) Int. Cl.
*A43B 21/52* (2006.01)
*A43B 21/40* (2006.01)
(Continued)

(52) U.S. Cl.
CPC ..... *A43B 21/52* (2013.01); *A43B 21/40* (2013.01); *A43B 21/51* (2013.01); *A43B 21/48* (2013.01)

(58) Field of Classification Search
CPC ..... A43B 21/40; A43B 21/36; A43B 21/51; A43B 21/48; A43B 3/246
See application file for complete search history.

(56) References Cited

U.S. PATENT DOCUMENTS 1,343,353 A 6/1920 Moineaux
1,479,421 A 10/1920 Powell
(Continued)

FOREIGN PATENT DOCUMENTS

FR 823964 1/1938
GB 239018 9/1925
(Continued)

OTHER PUBLICATIONS

Exhibit A: Three photos of prior art grand piano leg plates for fastening grand piano legs to a grand piano.
(Continued)

*Primary Examiner* — Ted Kavanaugh
(74) *Attorney, Agent, or Firm* — Erickson Law Group, PC

(57) ABSTRACT

An interchangeable heel device for a shoe is disclosed. The device has an upper heel block, a detachable heel, and a key. The key is in a top of the detachable heel or in a bottom of the upper heel block and a receiving recess is in the other of the detachable heel or upper heel block. The key is movable within the receiving recess between a released position and an engaged position. In the engaged position, each key first engagement portion is engaged with one of the receiving first engagement portions and each key second engagement portions is engaged with one of the receiving second engagement portions to join the key to the perimeter of the receiving recess and the heel to the sole. In the released position, each key first engagement portion is aligned with one of the receiving non-engagement recesses and the key is removable from the receiving recess.

27 Claims, 18 Drawing Sheets

(51) Int. Cl.
*A43B 21/48* (2006.01)
*A43B 21/51* (2006.01)

(56) References Cited

U.S. PATENT DOCUMENTS 1,439,600 A * 12/1922 Bonawitz ..... A43B 21/40 D2/968
1,575,664 A 8/1924 Van Roy
1,542,174 A 6/1925 Robidoux
1,557,564 A 10/1925 Daquino
1,611,024 A 12/1926 Grimaldi
1,631,710 A 6/1927 Tranides
1,633,449 A * 6/1927 Mayorowitz ..... A43B 21/51 36/36 C
1,709,332 A 5/1928 Tager
1,685,871 A 10/1928 Asher
1,709,749 A 4/1929 Hahbender
1,966,293 A 7/1934 Gillis
1,994,014 A 3/1935 Christensen
2,195,128 A 3/1940 Gillis
2,320,584 A 6/1943 Giesser
2,435,723 A * 2/1948 Elliott ..... A43B 21/37 36/36 R
2,439,310 A * 4/1948 Mancuso ..... A43B 21/40 36/42
2,795,867 A 6/1957 Zuckerman et al.
2,806,302 A 9/1957 Sharpe
2,837,841 A 6/1958 Twedt
2,943,404 A 7/1960 Sultan
3,064,367 A 11/1962 Henatsch
3,077,680 A * 2/1963 Moustakidis ..... A43B 21/40 D2/968
3,176,417 A 4/1965 Kapps
3,188,755 A 6/1965 Cortina
3,646,497 A 2/1972 Gillikin
4,014,115 A 3/1977 Reichert
4,610,100 A * 9/1986 Rhodes ..... A43B 21/39 36/36 A
4,805,320 A 2/1989 Goldenberg et al.
5,025,574 A 6/1991 Lasher, III
5,058,290 A 10/1991 Koehl et al.
5,343,649 A 9/1994 Petrovich
5,456,026 A 10/1995 Lewis
5,519,950 A 5/1996 Wang
5,953,836 A 9/1999 Watt et al.
6,711,835 B1 3/2004 Militello
7,185,448 B2 3/2007 Schupbach
7,578,075 B1 8/2009 Kemp
7,954,256 B2 6/2011 Colella
9,486,032 B2 11/2016 Morris Thill
10,201,209 B2 * 2/2019 Obie ..... A43B 3/246
11,737,517 B2 * 8/2023 Alviani ..... A43B 21/52 36/42
2001/0052195 A1 12/2001 Blakey
2003/0163934 A1 9/2003 Wallin et al.
2006/0075662 A1 4/2006 Schupbach
2011/0179670 A1 7/2011 Lepour
2013/0067770 A1 * 3/2013 Sherwood ..... A43B 21/39 36/100
2014/0259777 A1 9/2014 Morris Thill
2014/0298685 A1 10/2014 Alan et al.
2015/0201704 A1 7/2015 Huber

FOREIGN PATENT DOCUMENTS

GB 515306 12/1939
KR 10-2017-0046935 5/2017
WO 2016179675 11/2016

OTHER PUBLICATIONS

Exhibit B: A photo of a prior art grand piano leg plate fixed to a grand piano leg.

* cited by examiner

INTERCHANGEABLE HEEL DEVICE FOR A SHOE AND METHOD

U.S. patent application Ser. No. 16/864,880, filed May 1, 2020, is herein incorporated by reference.

FIELD OF THE INVENTION

This invention relates in general to interchangeable heel devices for shoes.

BACKGROUND OF THE INVENTION

Until now, all interchangeable heels have been complex and expensive to produce. Currently available interchangeable heels have bulky and complex mechanisms that may interfere with good shoe design and structure or invite malfunction over time.

The present inventor recognized that it would be desirable to allow the heels of shoes to be easily changed for other shoe heels onto the same shoe body, for any of several reasons, including but not limited to fashion, comfort, health and thriftiness. The present inventor recognized the need for an interchangeable heel device that is simpler, more secure, and less costly to manufacture. The present inventor recognized the need for an interchangeable heel device that could be mass-produced economically and would not necessarily be limited to hand-made boutique women's shoes.

The present inventor recognized that providing an interchangeable heel is important because many women have multiple activities during a single day, where it is impracticable to carry the variety of shoes socially required/desired. Many women cannot tolerate fashionable high heels for long periods of time, especially as they grow older. Further, it is common for a woman's feet to have been severely damaged from wearing traditional heeled shoes, limiting her activities, which may lead to obesity and other health issues, in addition to orthopedic issues.

The present inventor recognized the need for a device that enabled a user to carry optional or changeable heels on the user's person that could fit into nearly any pocket or handbag, to change out in seconds, making practicable fashion, comfort or better health as needed.

The present inventor recognized that an interchangeable heel is a desirable option for men's shoes because some men also have fashion or health requirements or desires similar to women as described above. Men also may want a more fashionable look for certain non-business activities.

The present inventor recognized the need for a device that could also be helpfully incorporated into dressy shoes for older children, especially girls, whose sensible parents don't want their fragile, developing feet in high heels all day when participating in, say, a family wedding.

It is common for the heel to be the first part of a shoe to wear unevenly, causing the user orthopedic issues or other joint pain, as well as possible tripping hazards. The present inventor recognized that shoes with a detachable heel could be sold with at least two pairs of heels. Further, the present inventor recognized the detachable heels would allow spare or extra heels to be readily available and sold separately at a later date. The present inventor recognized that a shoe with detachable heels enables a consumer to purchase identical heels (for a second "lease on life" for favorite shoes by new heels) or different height heels ("flats" and "high heels" for example) or different colors or styles for the same shoe. This would allow more fashion choices from the same high-quality shoe body, by offering an assortment of less-expensive heels. The present inventor recognized that a detachable or interchangeable heel shoe could allow users to make their own unique heel design on a 3-D printer.

The present inventor recognized that an interchangeable heel device could easily accommodate individuals with certain orthopedic issues, such as different length legs, by use of a shim or wedge between the body of the shoe and the heel, available either from a manufacturer or produced from a 3-D printer. The present inventor recognized the need for an interchangeable heel device to allow self-treatment of certain conditions without the need to use shoe insert on the insole which might compromise the shoe's fit and/or support. Such an interchangeable heel device could enable patients to access a wider variety of non-prescription shoe styles.

The present inventor recognized the need for an interchangeable heel device that is durable, simple to clean if ever required, compact and low-profile to simplify shoe design. The present inventor further recognized the need for a design that is discrete and out-of-sight when worn. The present inventor recognized the need for an interchangeable heel device that accommodates or comprises shims or wedges that could be helpful to alleviate orthopedic issues without compromising shoe fit or support, such as might be encountered when using inserts for use on top of the insole. The present inventor recognized the need of for an interchangeable heel device that can accommodate fashion options such as heels containing colored liquids, sparkles, LED lights, or other designs, if desired.

SUMMARY OF THE INVENTION

An interchangeable heel device for a shoe is disclosed. The interchangeable heel device provides a shoe with an interchangeable heel. Therefore, a shoe with an interchangeable heel is also disclosed.

In some embodiments, the interchangeable heel device comprises an upper heel block, a detachable heel, and a key. The key is in a top of the detachable heel or in a bottom of the upper heel block and a receiving recess is in the other of the detachable heel or upper heel block. The upper heel block is located in a heel area of a shoe below an insole of the shoe. The key is releasably engageable with the receiving recess.

The key has a first key side an opposite a second key side. The first and second key sides each have a key first engagement portion, a key second engagement portion, and a key non-engagement recess between the key first engagement portion and the key second engagement portion.

The receiving recess has a perimeter. The perimeter has a first receiving side opposite a second receiving side. The first and second receiving sides each have a receiving first engagement portion, a receiving second engagement portion, and a receiving non-engagement recess between the receiving first engagement portion and the receiving second engagement portion.

The key is movable within the receiving recess between a released position and an engaged position. In the engaged position each key first engagement portion is engaged with one of the receiving first engagement portions and each key second engagement portions is engaged with one of the receiving second engagement portions to join the key to the perimeter and the heel to the sole. In the released position, each key first engagement portion is aligned with one of the receiving non-engagement recesses. Then the key is removable from the receiving recess and the heel is removable from the shoe.

Numerous other advantages and features of the present invention will become readily apparent from the following detailed description of the invention and the embodiments thereof, from the claims, and from the accompanying drawings.

DETAILED DESCRIPTION

The following description is presented to enable any person skilled in the art to make and use the invention. For the purposes of explanation, specific nomenclature is set forth to provide a plural understanding of the present invention. While this invention is susceptible of embodiment in many different forms, this description describes and the drawings show specific embodiments of the invention with the understanding that the present disclosure is to be considered as an exemplification of the principles of the invention and is not intended to limit the invention to the specific embodiments illustrated.

Figure 1:
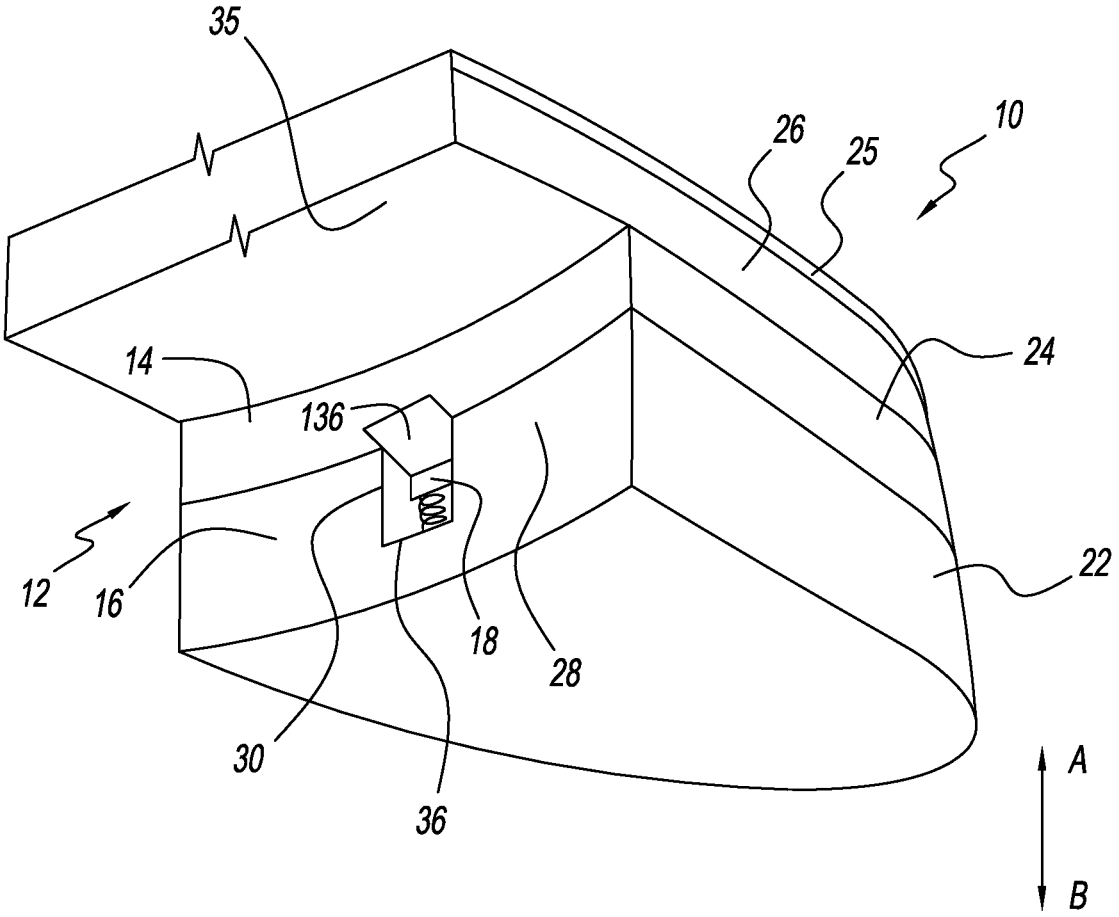
FIG. 1 is a bottom perspective view of a portion of a shoe having an interchangeable heel device of the invention.

FIG. 1 shows a portion of a shoe 10 comprising a interchangeable heel device 12. The device 12 comprises an upper heel block 14, a lower heel block 16, and a stop 18. The device 12 removably attaches a heel 22 to a sole 26 or upper heel portion 24 of the shoe 10. The sole 26 may comprise an insole 25, which may be for contact with a user's foot.

In some embodiments, the stop 18 is exterior of a front 28 of the heel 22 under the mid-sole 35 of the sole 26. In some embodiments, the stop 18 is integrated within a recess 30 of the heel at the front 28. The recess is large enough to allow vertical movement of the stop 18 in and out of the stop home opening 32 of the upper heel block 14.

Figure 3:
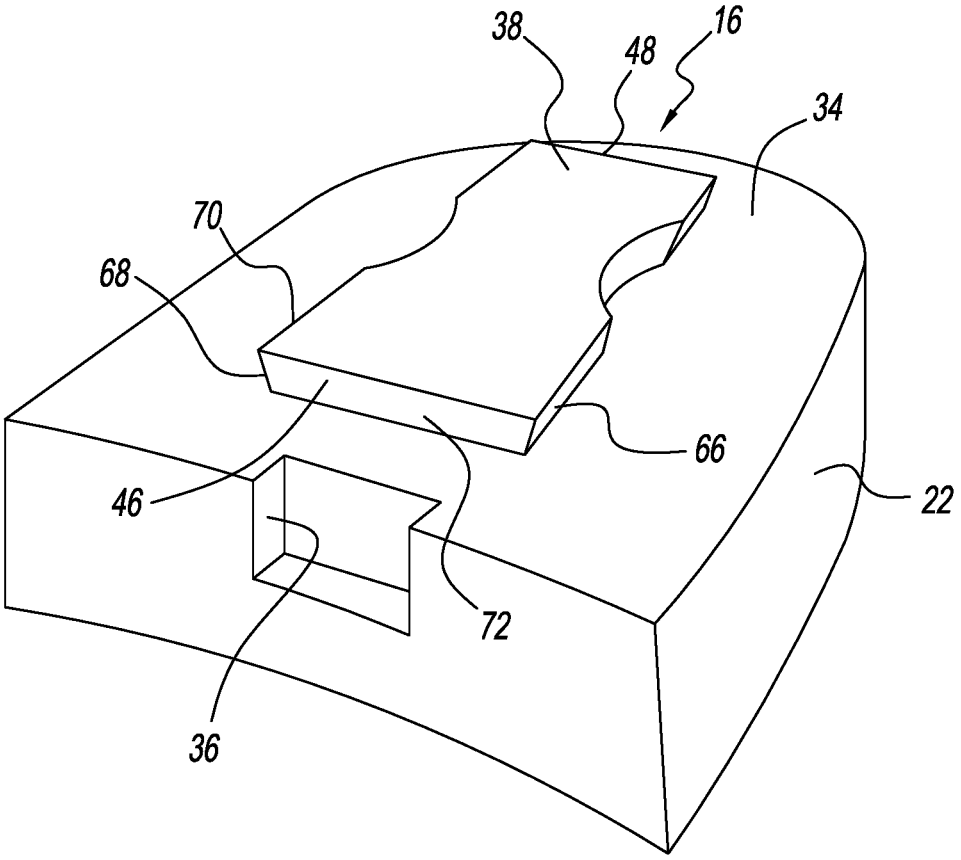
FIG. 3 is a front perspective view of a lower heel block, and key of the interchangeable heel device of FIG. 1.
Figure 4:
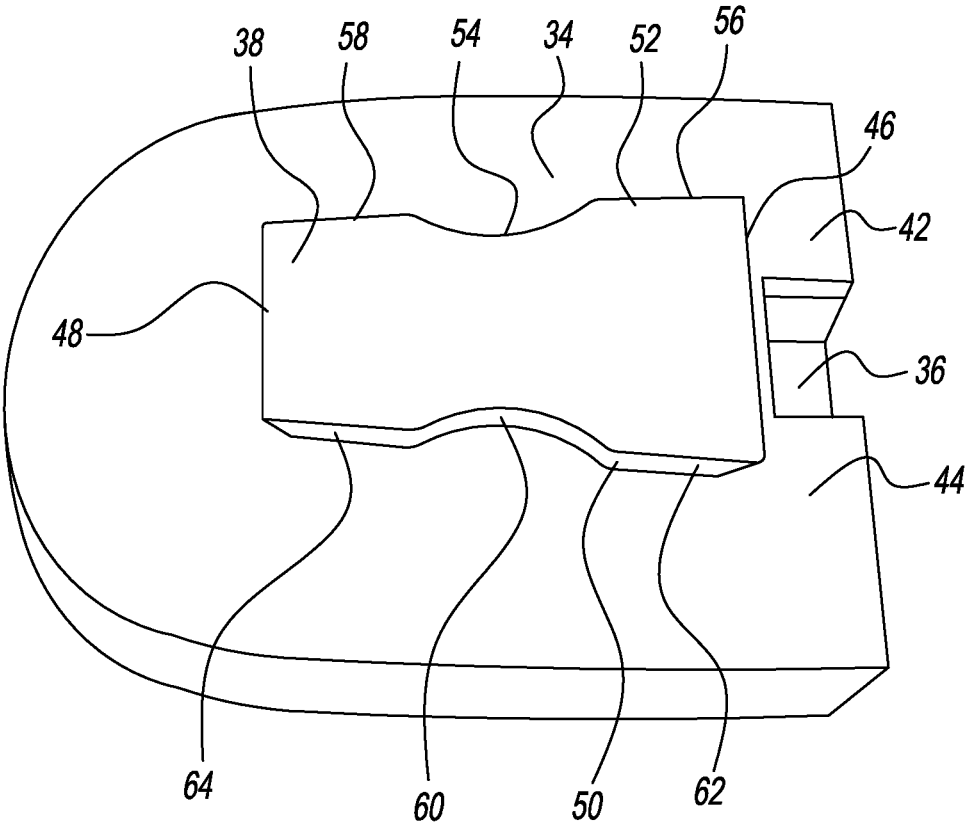
FIG. 4 is a top perspective view of the lower heel block and key of FIG. 3.
Figure 5:
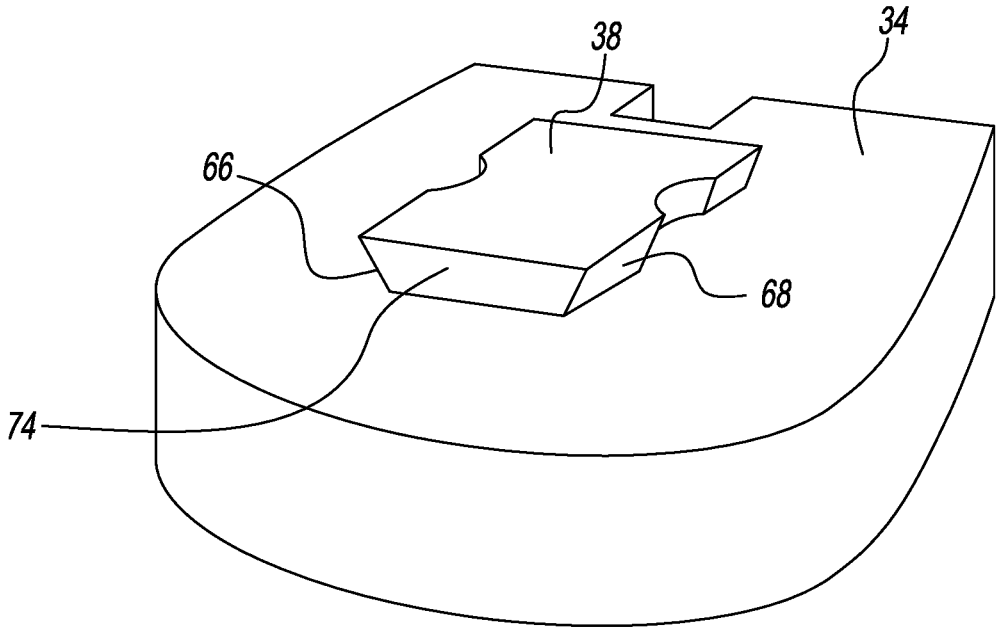
FIG. 5 is a rear perspective view of the lower heel block and key of FIG. 3.

FIG. 3 shows the lower heel block 16. The lower heel block comprises a base 34. In some embodiments the base 34 is flat. In some embodiments the base 34 comprises a slight curve or is otherwise not flat. The base 34 comprises a front notch 36 for the stop 18 to pass through. Projections 42, 44 are provided on opposite sides of the notch 36. Extending from the base is a key 38.

The key 38 comprises a front end 46, and back end 48, a first side 50, and a second side 52. The front end 42 is narrower than the back 48 end. The first and second sides converge toward each other from the backend to the front end. This provides the key with a wedge-shape having a truncated back end 48.

The first side comprises a first indent 54 between a forward portion 56 and a rearward portion 58. The second side comprises a second indent 60 between a forward portion 62 and a rearward portion 64. The first and second indents can be curved, semi-circular, quadrilateral, or other shape.

The first side 50 comprises a first sidewall 66 and the second side 52 comprises a second sidewall 68. The sidewalls 66, 68 converge as they extend from a top 70 of the key to the base 34. In some embodiments, each sidewall 66, 68 is angled to provide an angle 61 (FIG. 12) between 80 degrees and 45 degrees, inclusive, from the adjacent floor of the base 34, but other angles can be used. In some embodiments, the sidewalls at the indents 54, 60 are converging. In some embodiments, the sidewalls at the indents 54, 60 are not converging while the adjacent forward and rearward portions 52, 58, 62, 64 of the sidewalls are converging.

The front end 46 comprises a front wall 72 and the back end 48 comprises a back wall 74. In some embodiments, the front wall and back wall converge as they extend from the top 70 of the key to the base 34. In some embodiments, the front wall and the back wall are angled to provide an angle between 80 degrees and 45 degrees, inclusive, between the respective front wall or back wall and the adjacent surface of the base 34, but other angles can be used.

Figure 6:
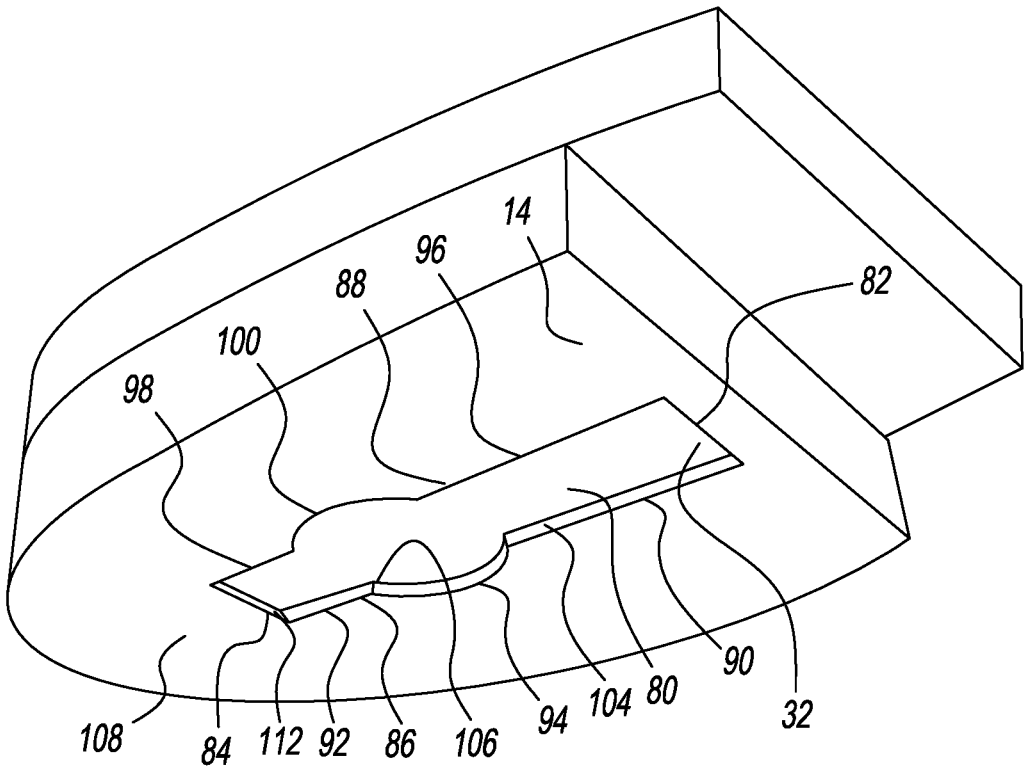
FIG. 6 is a bottom side perspective view of an upper heel block and key opening of the interchangeable heel device of FIG. 1.
Figure 7:
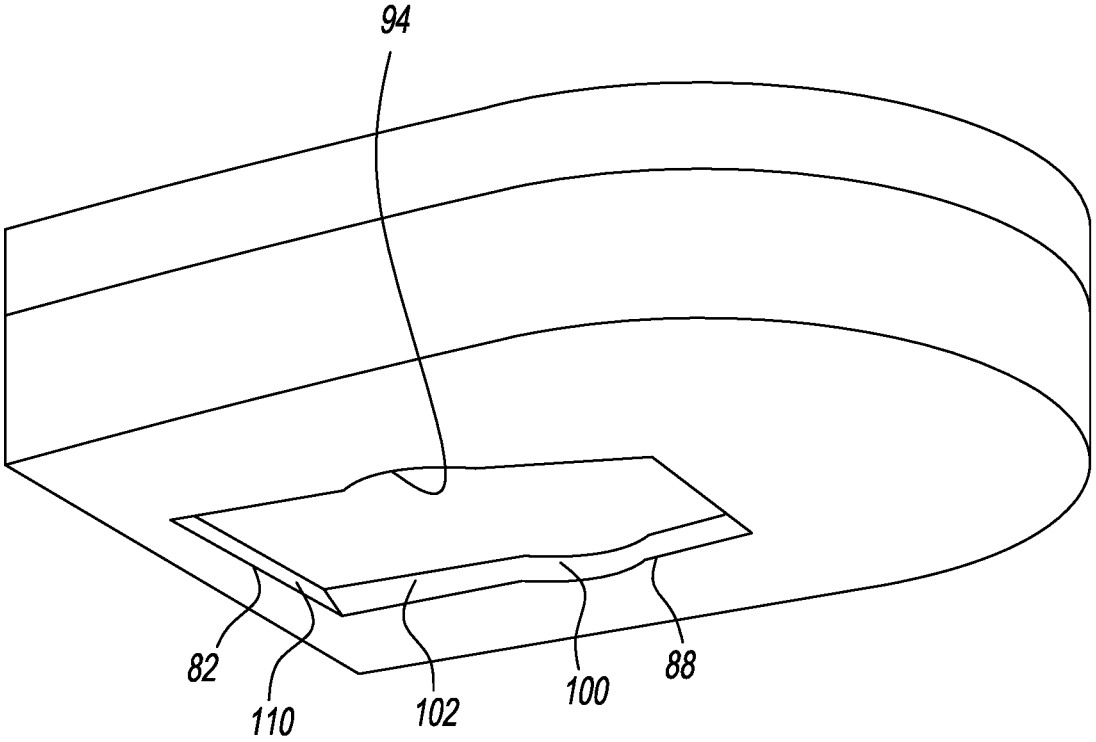
FIG. 7 is a bottom side perspective view of an upper heel block and key opening of FIG. 6.
Figure 8:
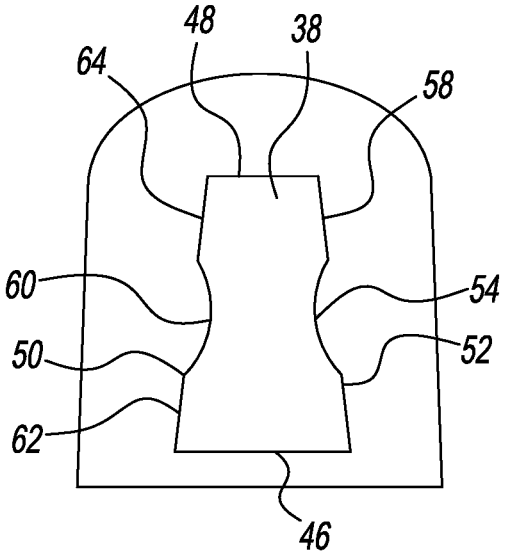
FIG. 8 is a top view of the key of FIG. 4.

FIGS. 6 and 7 shows the upper heel block 14. The heel block 14 comprises a receiving recess or key opening 80. The opening 80 comprises a perimeter comprising a front end 82, a rear end 84, a first side 88, and a second side 86. In some embodiments, the recess 80 has a wedge-shape from a front end 82 with a truncated rear end 84. The receiving recess 80 comprises the stop home opening 32 as shown in FIG. 6 at the front end 82.

In some embodiments, the device 12 comprises the receiving recess or key opening 80 in the sole 26, rather than in an upper heel block.

The first side 88 comprises a first indent 100. The first indent 100 is between a forward portion 96 and a rearward portion 98. The second side 86 comprises a second indent 94. The second indent 94 is between a forward portion 90 and a rearward portion 92.

Figure 12:
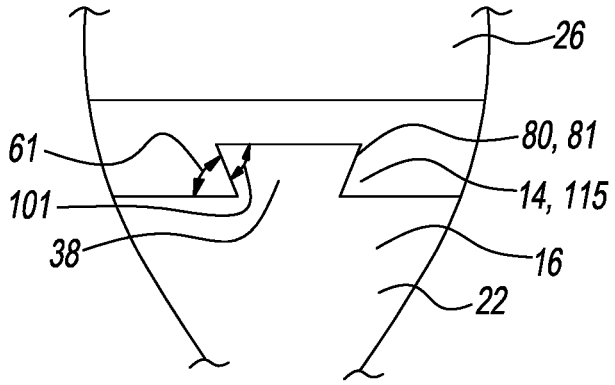
FIG. 12 is a rear section view of the key and key opening taken along 12-12 of FIG. 11.

The first side 88 comprises a first sidewall 102 and the second side 86 comprises a second sidewall 104. The sidewalls 102, 104 converge as they extend from a top 106 of the opening 80 to a bottom 108 of the heel block 14. In some embodiments, each sidewall 102, 104 has an angle 101 (FIG. 12) that is complementary and configured to mate with the angle of the side wall 66, 68 of the key 38, as shown in FIG. 12 in a dovetail engagement. In some embodiments, each sidewall 102, 104, is angled to provide an angle of between 80 degrees and 45 degrees, inclusive, between the respective sidewall and the adjacent surface of the bottom 108, but other angles can be used. In some embodiments, the sidewalls at the indents 94, 100 are converging. In some embodiments, the sidewalls at the indents 94, 100 are not converging while the adjacent forward and rearward portions 90, 92, 96, 98 of the sidewalls are converging.

The front end 82 comprises a front wall 110 and the rear end 84 comprises a back wall 112. In some embodiments, the front wall and back wall converge as they extend from a top 106 of the opening 80 to the bottom 108 of the heel block 14. The front wall 110 and the back 112 wall each comprise an angle that is complementary and configured to mate with the angle of the front wall 72 and back wall 74, respectively, of the key 38 in a dovetail engagement. In some embodiments, the front wall 110 and the back wall 112 are each angled to provide an angle of between 80 degrees and 45 degrees, inclusive, between the respective sidewall and adjacent surface of the bottom 108, but other angles can be used.

Figure 9:
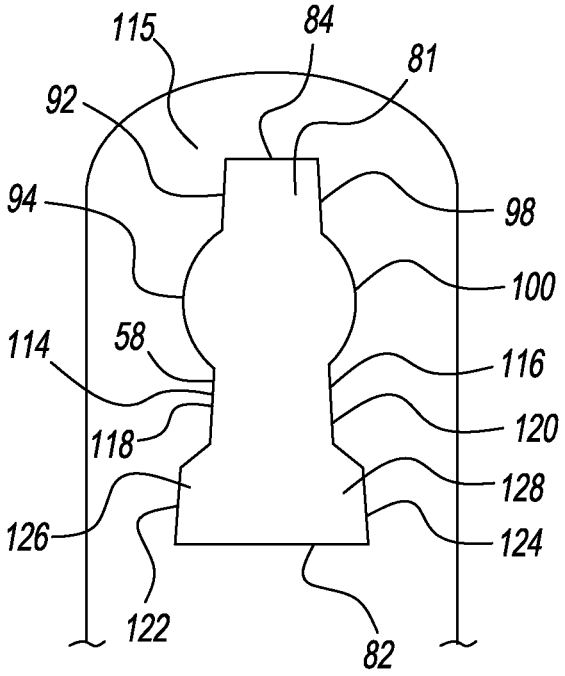
FIG. 9 is a bottom view of a second embodiment top heel block and key opening of the invention.
Figure 10:
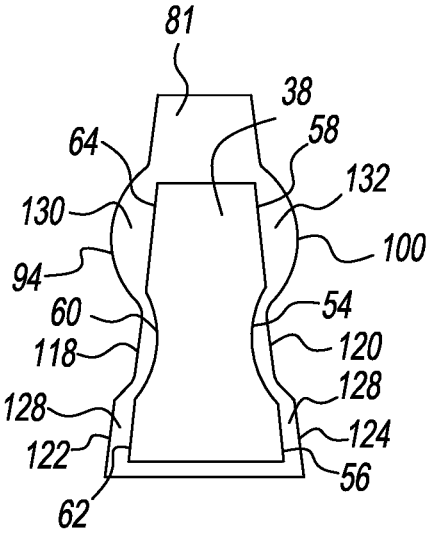
FIG. 10 is a top view of the key of FIG. 8 and the key opening of FIG. 9 with the key shown in a first position.

FIG. 9 shows a second embodiment upper heel block 115, which is the same as heel block 16 except for the shape of the forward portions 118, 120. The sidewalls 114, 116 have forward portions 118, 120 that comprise a forward protrusions 122, 124 creating forward recesses 126, 128. The forward recesses 126, 128 are configured to receive forward portions 52, 62 of the key 38 as shown in FIG. 10. In the embodiment of heel block 16, the forward portions 90, 96 of the heel block 16 are spaced apart sufficiently to allow the forward portions 52, 62 of the key to be received between the forward portions 90, 96.

To engage the key 38 with the upper heel block 14, 115, the key is positioned so that the forward portions 52, 62 are below the forward recesses 126, 128 in the case of heel block 115 or the forward portions 90, 96 in the case of heel block 16. The key is further positioned so that the rearward portions 58, 64 are positioned below the recessed areas 130, 132 formed by the indents 94, 100 of the upper heel block 14, 115. This also causes the portions 118, 120 to be aligned with the spaces allowed by the indents 54, 60 of the key. Then the key is moved upward in the direction A (FIG. 1) so that the key is received in the key opening 80, 81.

Then the key is moved backward in the direction C (FIG. 11) to a locked or engaged position where there is a dove-tail engagement between the sidewall 66 of rearward portion 58 of the key and side wall 102 of the rearward portion 98 of the upper heel block 14, 115, and a dove-tail engagement between the sidewall 68 of the rearward portion 64 of the key and the sidewall 104 of the rearward portion 92 of the upper heel block 14, 115. There will also be a dove-tail engagement between the sidewall 66 of the forward portion 56 of the key and the sidewall 104 of the forward portion 120, 96 of the heel block 115, 16, and a dove-tail engagement between the sidewall 68 of the forward portion 62 of the key and the sidewall 104 of the forward portion 118, 90 of the heel block 115, 16. Further, the indents 54, 60 of the key may be aligned with the respective indents 100, 94 of the heel blocks 115, 16 when in the engaged position as shown in FIG. 11.

FIG. 12 shows a cross-section view of the dovetail engagement between the key 38 and the heel block 115, 14 at portions 56, 62, 118, 120. The engagement at portions 58, 64, 92, 98 is also a dovetail engagement providing a view thereof similar to that of FIG. 12. In some embodiments, at least the portions 65, 62, 68, 64 of the key may be considered a tenon that engage with the sidewall portions 94, 98, 90, 94, 118, 120, which may be considered a mortise.

Figure 11:
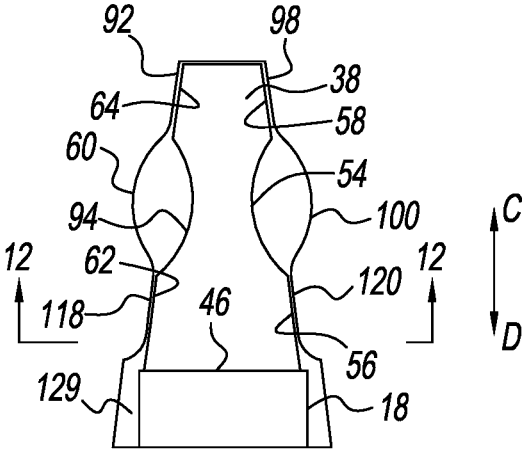
FIG. 11 is a top view of the key of FIG. 8 in the key opening of FIG. 9 with the key shown in a second engaged position.

When the key is in the engaged position shown in FIG. 11, the stop 18 may be inserted into an stop home opening 129 at the front of the key opening 80, 81 and adjacent the front 46 of the key to prevent all or substantial movement of the key in the forward direction D (FIG. 11) and to keep the key securely engaged with the upper heel block 14, 115.

Figure 13:
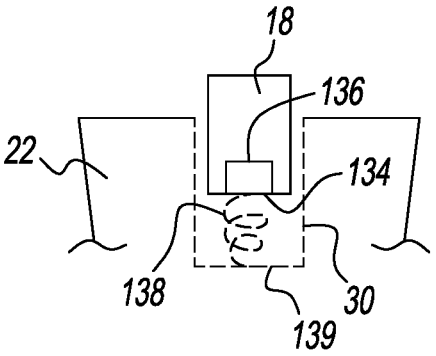
FIG. 13 is a front view of the heel of the shoe of FIG. 1 with a spring recess.

FIG. 13 shows that the stop 18 may be spring biased to the extended/engaged position. A spring 138 may be placed between a bottom 139 of the stop 18 and a bottom 132 of the recess 30 in the heel 22. The spring 138 biases the stop 18 to an engaged position in the stop opening 129 at the front of the key opening 80, 81 and adjacent the front 46 of the key to prevent all or substantial movement of the key in the forward direction D (FIG. 11) and to keep the key securely engaged with the upper heel block 14, 115. The stop 18 may be provided with a handle or protrusion 136 that provides a place for a user to pull the stop down from the engaged position to a disengaged position so that the key 38 can be removed from the heel block 14, 115.

When the stop is withdrawn or removed from the stop opening, the key maybe be moved forward in the direction D until the key is in the position shown in FIG. 10 and then its may be moved downward in the direction B (FIG. 1) to remove the key from the heel block 14, 115 and to remove the heel 22 from the shoe 10.

In some embodiments the key 38 is integrated with the heel 22 and extends from the heel 22 with or without a base 34. In some embodiments, the key opening 80, 81 is formed on the bottom of the sole 26 or upper heel portion 24 with or without a heel block 14, 115.

The key and or the lower heel block 16, 156 can be attached or formed on a variety of heels, such as high heels, low heels, flat heels, no-rise heels, Stellato heels, etc. so that a variety of heels can be interchangeably used with the same shoe.

Figure 14:
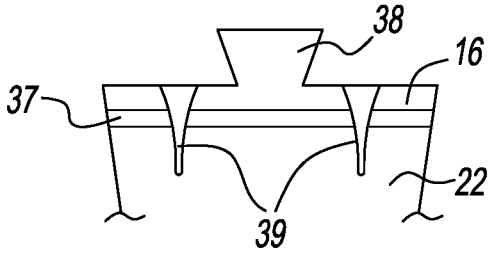
FIG. 14 is a front view of a key and heel used with a shim.

FIG. 14 shows the use of a shim 37 between the lower heel block 16 and the heel 22. In some embodiments multiple shims are used to achieve the desire height. In some embodiments, the shims could be wedges having a taller height at one end of the wedge as compared to another end of the wedge. Wedges or shims could be appropriate where more or less heel height is desired in one shoe for one foot than the other shoe/foot. The wedges or shims could be appropriate to finely adjust the desired heel height in both shoes. The shims and the lower heel block 16 can be joined to the heel 22 with fasteners such as screws 39 or an adhesive or other fastener. The lower heel block can be joined to the shim or wedge and the wedge or shim can be joined to the top of the heel 22. The heel block 14 can be joined to the sole 26 or the heel portion 24 with adhesive or other fastener.

Figure 15:
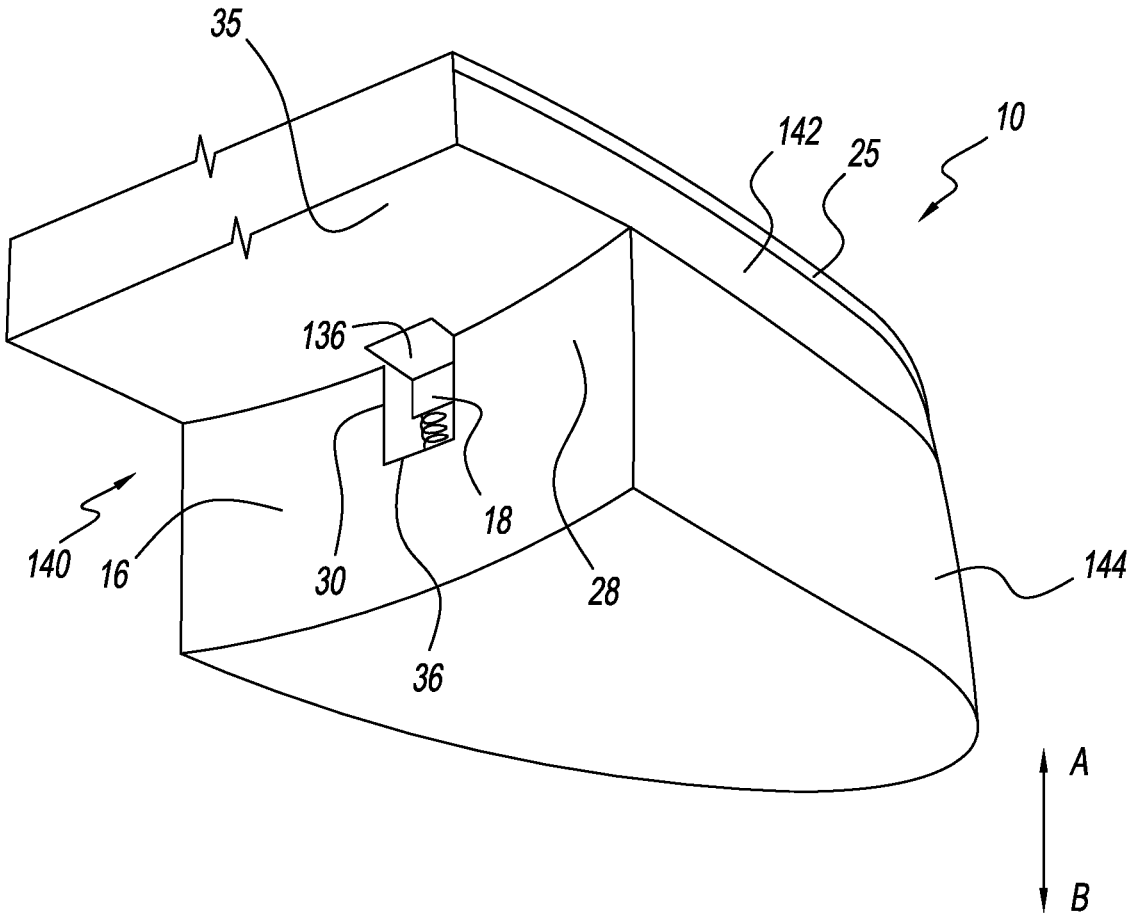
FIG. 15 is a bottom perspective view of a portion of a shoe having a second embodiment interchangeable heel device of the invention.
Figure 16:
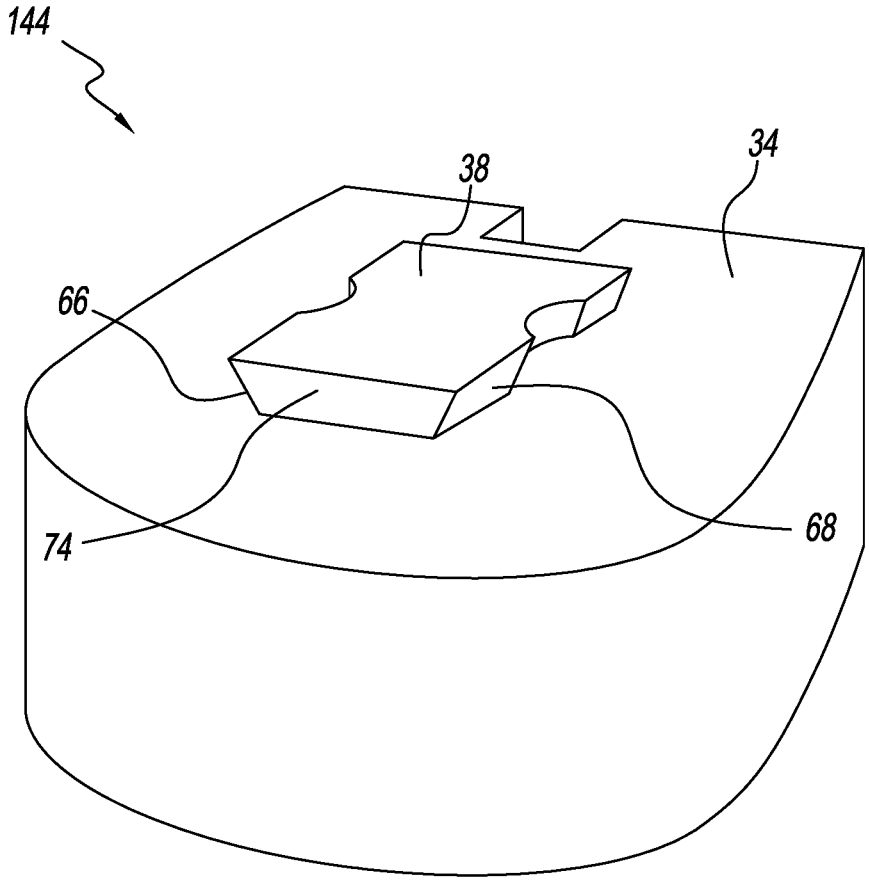
FIG. 16 is a rear perspective view of the heel and key of the interchangeable heel device of FIG. 15.
Figure 17:
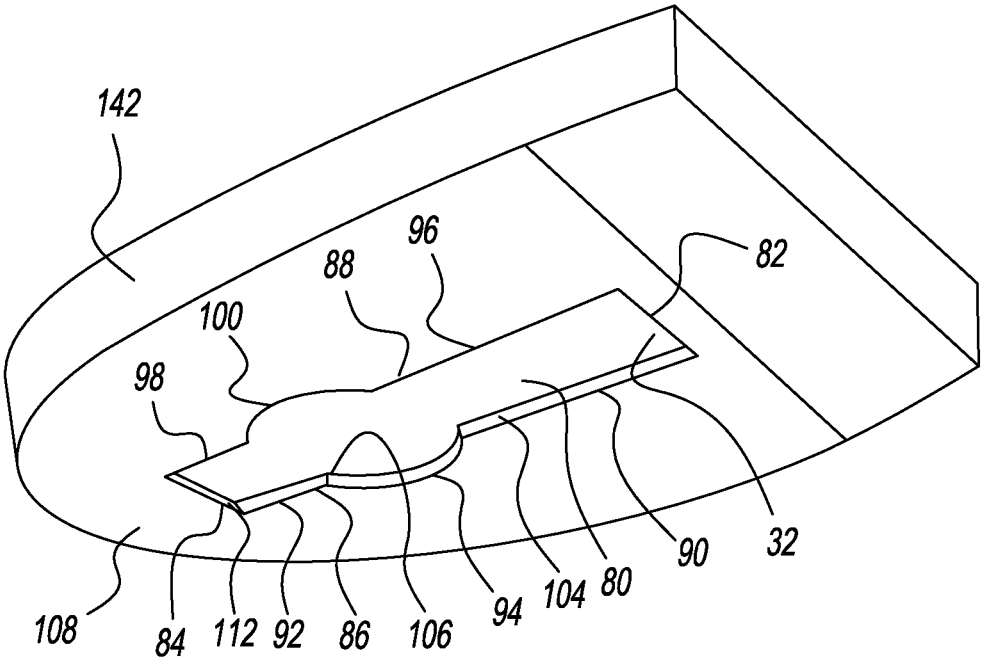
FIG. 17 is a bottom side perspective view of the sole and key opening of the interchangeable heel device of FIG. 15.

FIGS. 15 to 17 shows a shoe 10 with a second embodiment interchangeable heel device 140 comprising heel 144 and the key opening 80 in the sole 142. The sole 142 is the same as sole 26 except that the sole 142 comprises the receiving recess or key opening 80. Therefore, the shoe 10 of FIG. 15 does not have an upper heel block. The heel 144 is the same as lower heel block 16 except that heel 144 is shown having a taller height in the figures. The heel 144 comprises the key 38. The heel 144 is removably connected to the bottom of the sole 142 by engaging the key 38 in the key opening 80, as described above regarding device 12.

FIGS. 18 to 25 show a shoe 10 with a third embodiment interchangeable heel device 152 comprising an upper heel block 154, a lower heel block 156, and a stop 158. The device 152 removably attaches a heel 160 to the upper heel portion 162 or the sole 164 of the shoe 10. The sole 164 may comprise an insole on the top, such as positioned as shown for insole 25 on sole 26, which may be for contact with a user's foot.

Figure 22:
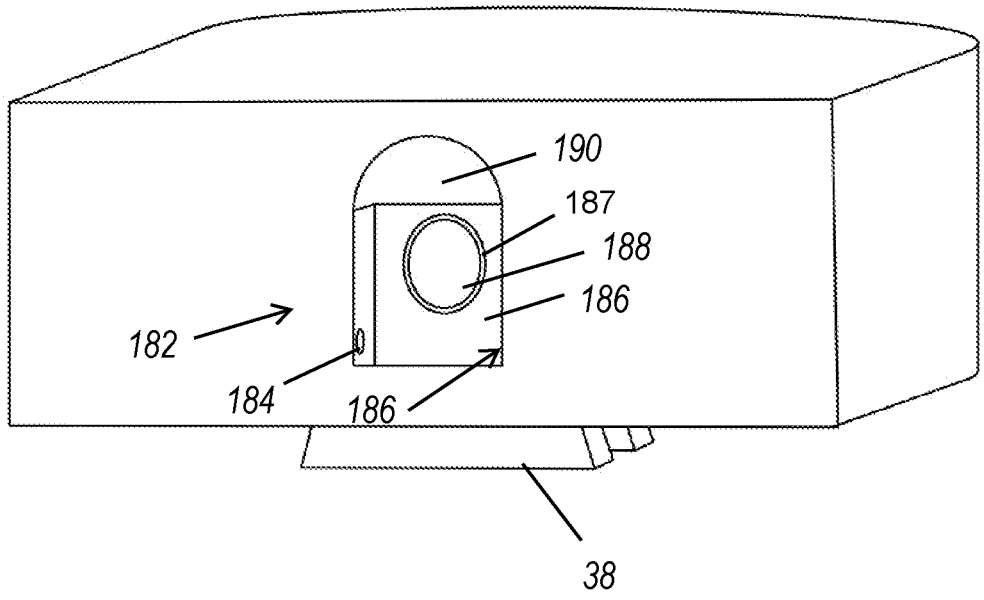
FIG. 22 is a front of an upper heel block of the interchangeable heel device of FIG. 18 with certain parts not shown.

The upper heel block 154 comprises a key 38, which is the same as key 38 of lower heel block 16, yet the key 38 is located on the upper heel block 154, rather than the lower heel block 16 of device 12. The lower heel block 156 comprises a receiving recess or key opening 80 (FIG. 22). The key opening 80 is the same as key opening 80 upper heel block 14, yet opening 80 is located in the top of lower heel block 156, rather than in upper heel block 14 of device 12. The key 38 and key opening 80 of device 152 are inverted from the positions of the key 38 and key opening 80 in device 12. In some embodiments, the key opening 81 is used in lower heel block 156 in place of key opening 80.

The stop 158 is mounted in a stop housing 164 in the upper heel block 154. The stop is moveable between a released position shown in FIG. 20 and an engaged position shown in FIG. 19.

Figure 21:
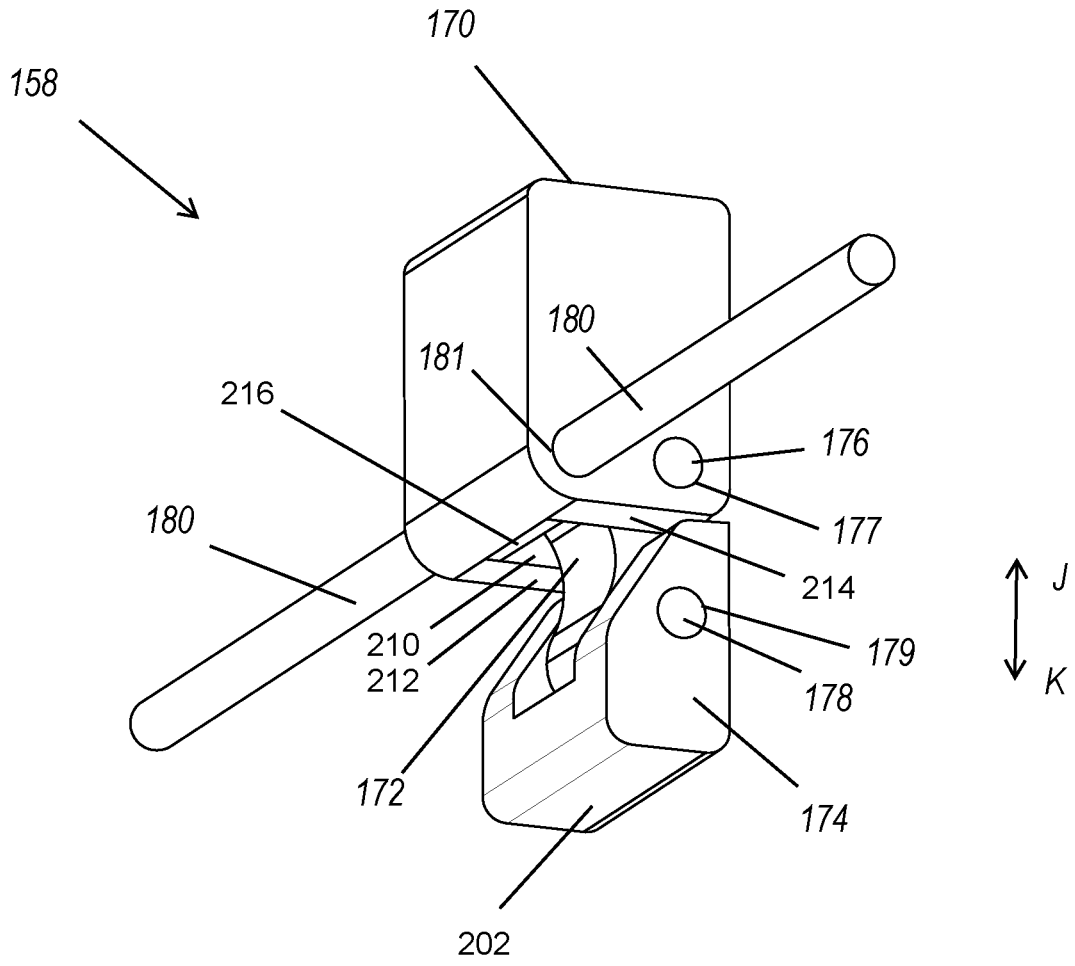
FIG. 21 is a perspective view of a stop of the interchangeable heel device of FIG. 18.
Figure 23:
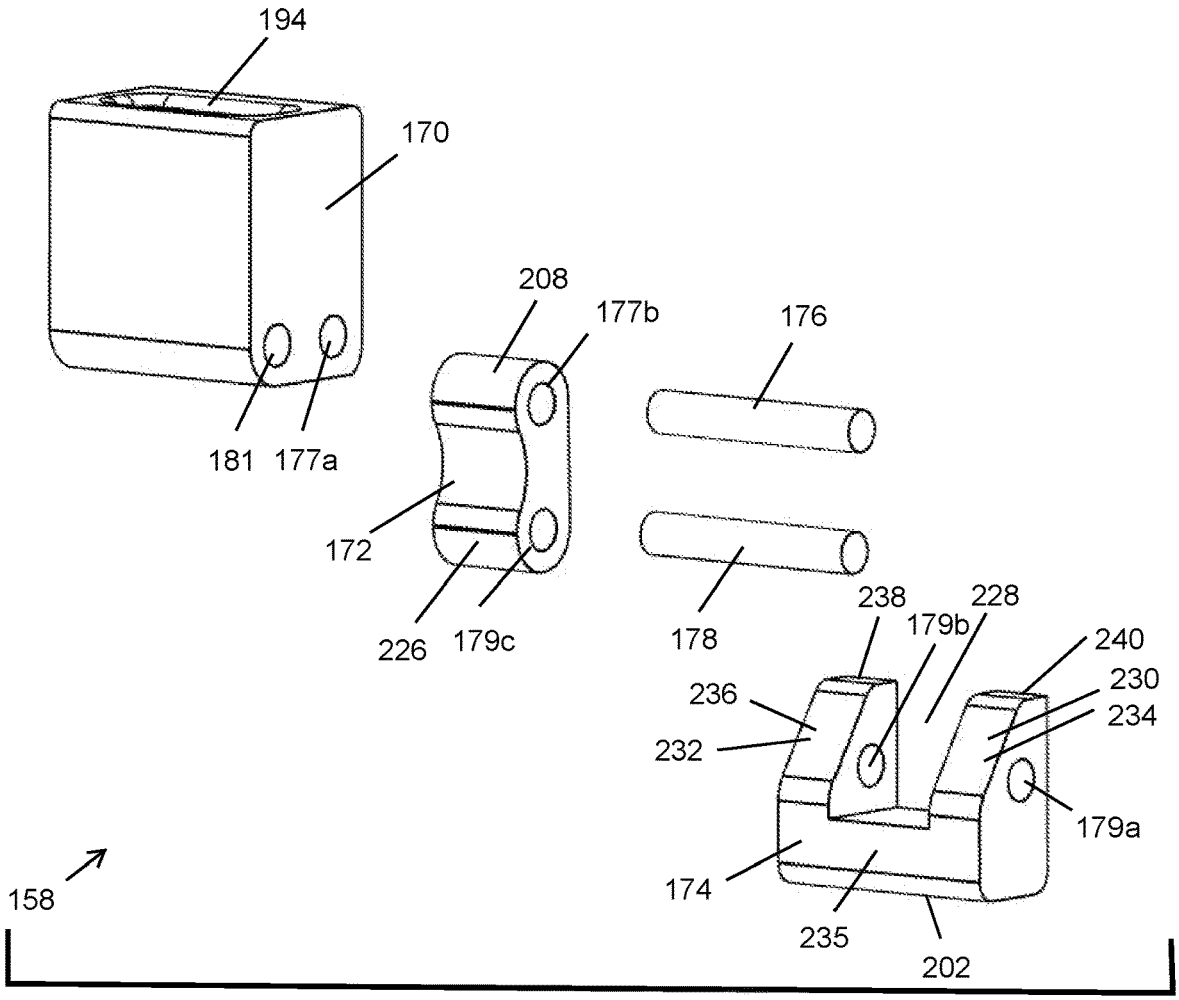
FIG. 23 is an exploded perspective view of the stop of FIG. 21.
Figure 24:
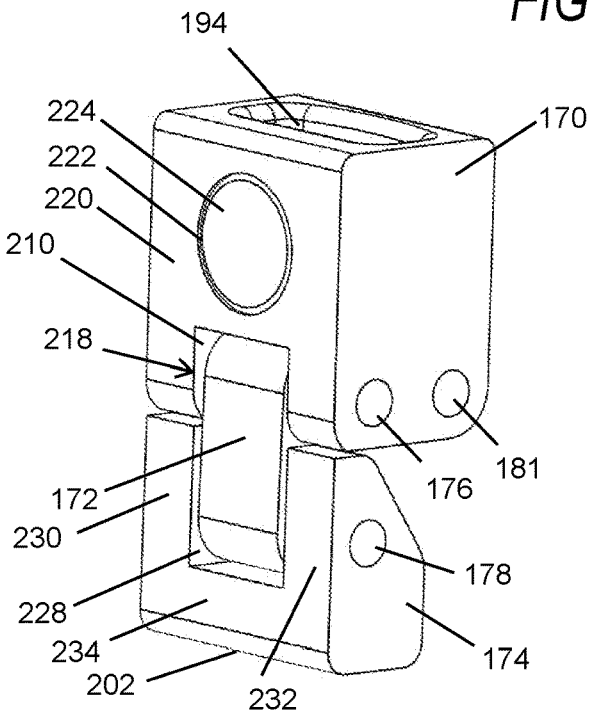
FIG. 24 is a rear perspective view of the stop of FIG. 21.
Figure 25:
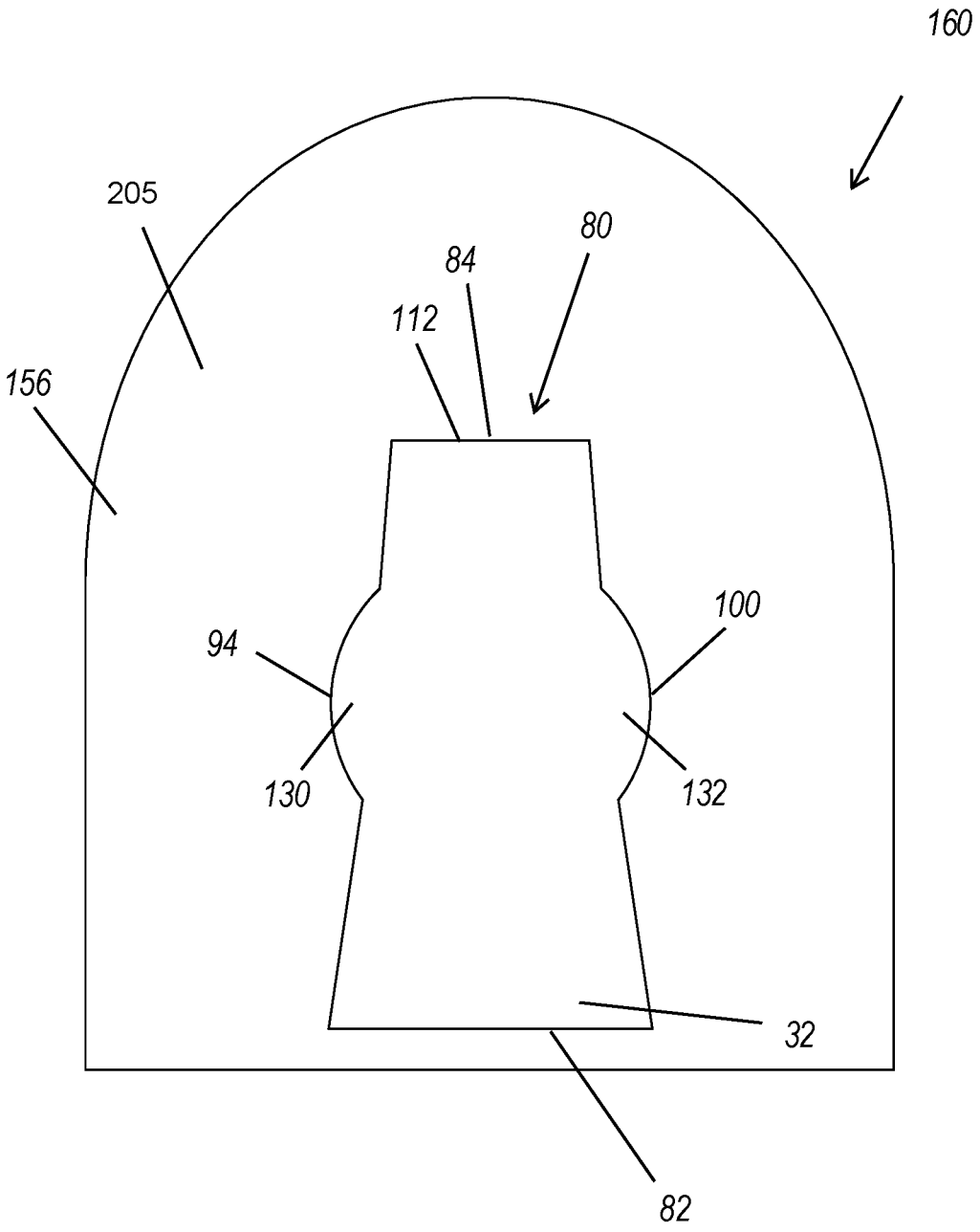
FIG. 25 is a top view of the lower heel block of the interchangeable heel device of FIG. 18.

As shown in FIGS. 21, 23, and 24, the stop 158 comprises a pull arm 170, a middle arm 172, and an engaging arm 174. The pull arm 170 is pivotally connected to the middle arm 172 at a first pin 176. The first pin 176 extends through a first transverse aperture 177*a* in the upper arm and a first transverse aperture 177*b* in the middle arm at a top 208 of the middle arm. The middle arm 172 is pivotally connected to the engaging arm 174 at a second pin 178. A top 208 of the middle arm 172 is received in a bottom opening 210 of the pull arm 170. Therefore, the middle arm is pivotal at least partially within the bottom opening of the pull arm. The opening 210 in the bottom is bounded by sidewalls 212, 214 on opposite transverse sides and by a front wall 216. The opening 210 is open to the bottom and open to a lower back 218 of the pull arm.

A back 220 of the pull arm comprises a recess 222. Within the recess is magnetically attracted material 224. The magnetically attracted material 224 is material that is attracted by a magnet. In some embodiments, the material 224 is a ferromagnetic material. In some embodiments the material 224 is in the form of a block or a disk.

The second pin 178 extends through a second transverse aperture 179*a* and a third transverse aperture 179*b* in the engaging arm 174 and a second transverse aperture 179*c* at a bottom 226 of the middle arm 172. The second transverse aperture 179*a* and a third transverse aperture 179*b* are axially aligned as shown in FIG. 23. The middle arm 172 is received an opening 228 of the engaging arm 174. The opening 228 is bounded on opposite transverse sides by sidewalls 230, 232. Each of the sidewalls 230, 232 have angled walls 234, 236 that terminate at a top wall 238, 240, respectively. The second transverse aperture 179*a* extends through sidewall 230 and the third transverse aperture 179*b* extends through sidewall 232. Each of the sidewalls 230, 232 join to the cross portion 235 as shown in FIG. 23.

Figure 18:
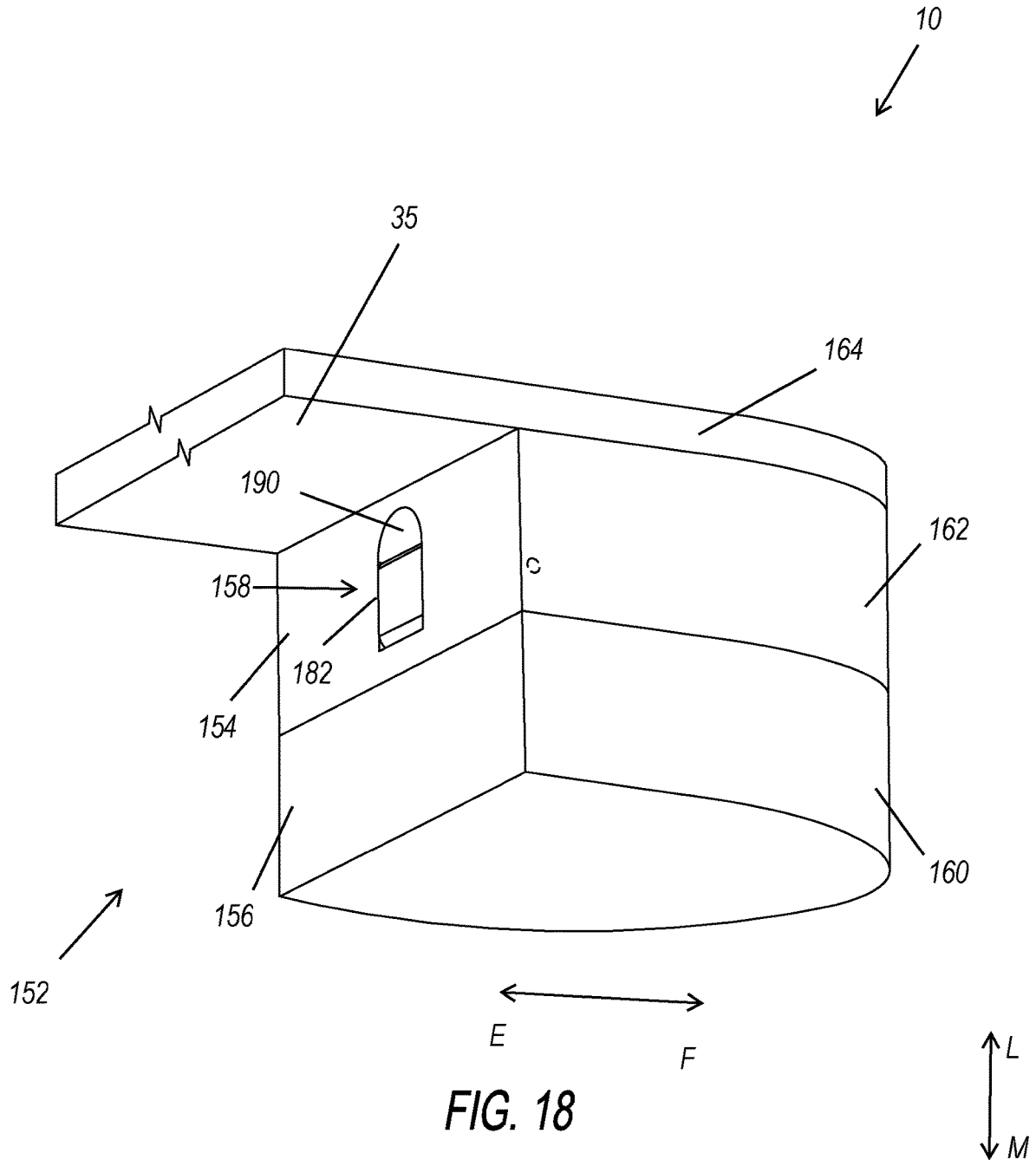
FIG. 18 is a bottom perspective view of a portion of a shoe having a third embodiment interchangeable heel device of the invention.
Figure 19:
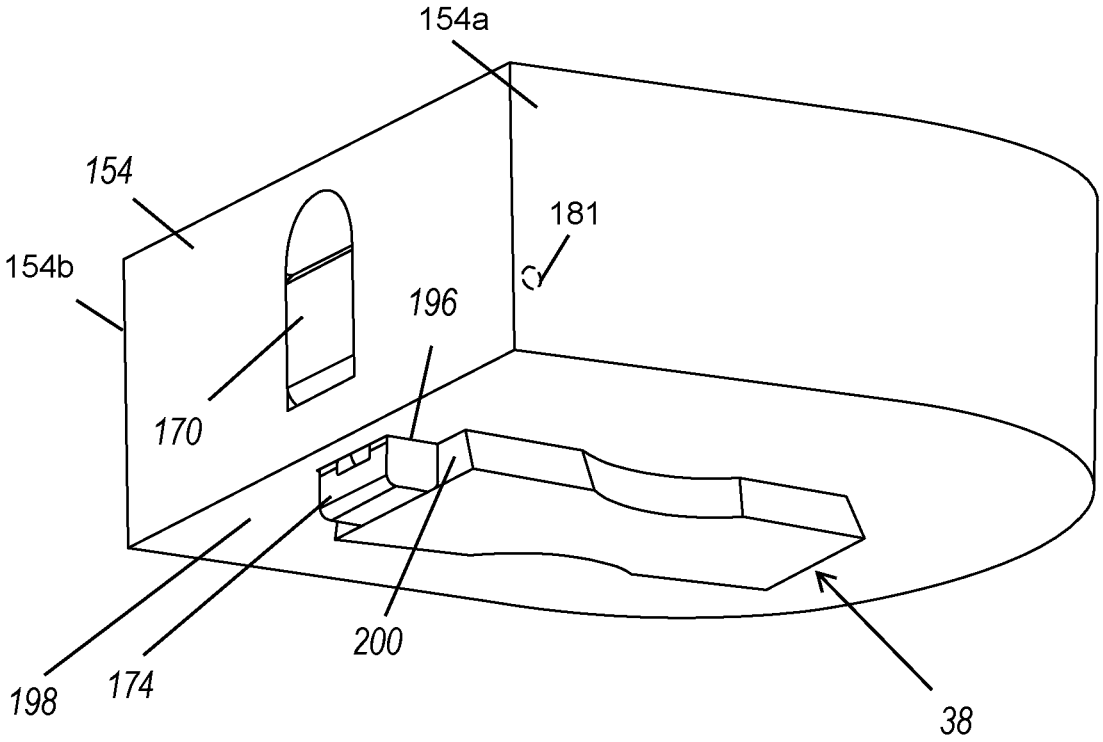
FIG. 19 is a bottom perspective view of an upper heel block of the interchangeable heel device of FIG. 18.
Figure 20:
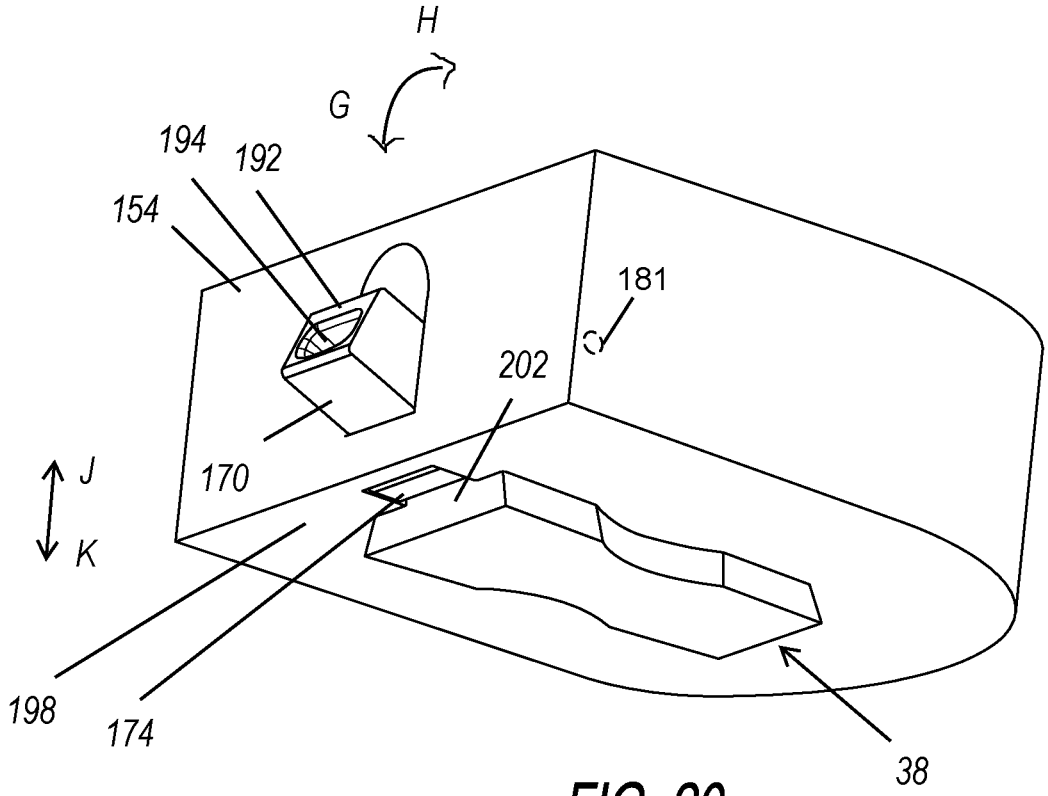
FIG. 20 is a bottom perspective view of an upper heel block of the interchangeable heel device of FIG. 18.

The pull arm 170 is pivotally connected to the upper heel block by a third pin 180 that extends through the pull arm 170. The pull arm 170 is mounted to the upper heel block by the third pin 180. The third pin extends transversely through a third transverse aperture 181 in the pull arm. In some embodiments, the third transverse aperture 181 is horizontally aligned with the first transverse aperture 177 when in the position shown in FIG. 21. The third pin 180 is located in a third transverse aperture 184 and in an opposite fourth transverse aperture at 186 extending within the upper heel block from opposite sides of the pull arm housing 182 in the upper heel block. The broken line circles in FIGS. 18, 19, and 20 show the position of one end of the third pin 180. However, usually, the pin 180 will not be visible on the sides 154*a*, 154*b* of the upper heel block.

The back wall 186 of the housing 182 comprises a back recess 187 containing a magnet 188. The top of the housing 182 comprises a finger opening 190 for accessing the top 192 of the pull arm 170. In some embodiments, the top of the pull arm 170 comprises a grip recess 194.

When the stop 158 is in the engaged position shown in FIGS. 18 and 19, the engaged arm extend through a lower aperture 196 and below a base 198 of the upper heel block. The key 38 extend below the base 198 as shown in FIGS. 19 and 20. The lower aperture 196 and the engaging arm 174, when in the engaged position, are adjacent to the front wall 72 of the key 38. In some embodiments, the engaging arm 174 is in surface-to-surface contact or close proximity with the front wall 72 of the key 38 when the stop is in the engaged position.

When the stop 158 is in the released position shown in FIG. 20, the bottom wall 202 of the engaging arm 174 is positioned at or above the base 198, thereby allowing the upper heel bock to move relative to the lower heel block and the key 38 to move within the key opening 80. When the stop is in the released position the key can be moved to the front end 82 of the key opening 80. The movement of the key to the front of the key opening can be achieved by moving the lower heel block 156 rearward in the direction F (FIG. 18), or moving the upper heel block (and shoe) forward in the direction E, or both. Then the lower heel block 156 is moved down in the direction M and or the upper heel block (and shoe) is moved upward in the direction L away from the lower heel block. Therefore, the heel 160 is removed from the shoe.

To move the stop from the engaged position to the released position, a user places his or her finger into the finger opening 190 and in contact with the top 192 of the pull arm 170 or into the grip recess 194. Then the user pulls the pull arm forward and down in the direction G of FIG. 20. When the user pulls the pull arm forward, the pull arm pivots forward about the third pin 180. The forward pivot about the third pin 180 lifts upward in the direction J of FIGS. 20 and 21 the first pivot pin, the middle arm 172, and the engaging arm 174.

Therefore, the movement of the pull arm forward and down in the direction G causes the engaging arm 174 to move upward in the direction J toward and to the retracted position shown in FIG. 20 where the bottom 202 of the engaging arm is flush with or above the base 198 of the upper heel block 154.

When the stop is in the released position shown in FIG. 20, the angled walls 236, 234 of the engaging arm will be contacting or in close proximity with the bottom walls 212, 214 of the pull arm 170, respectively. In some embodiments, when the stop is in the released position shown in FIG. 20, the angled walls 236, 234 of the engaging arm will be parallel or substantially parallel to bottom walls 212, 214 of the pull arm 170, respectively. When the stop is in the engaged position, the bottom walls 212, 214 are in close proximity to the tops 240, 238 as shown in FIG. 21

To move the stop from the released position to the engaged position, a user pushes the pull arm up and back in the direction H of FIG. 20. When the user pushes the pull arm back, the pull arm pivots backward about the third pin 180. The backward pivot about the third pin 180 pushes downward in the direction K of FIGS. 20 and 21 the first pivot pin, the middle arm 172, and the engaging arm 174. This pushing of the engaging arm 174, lowers the engaging arm 174. Therefore, the movement of the pull arm upward and backward in the direction H causes the engaging arm 174 to move in the direction K toward and to the engaged position shown in FIG. 19 where the engaging arm extends below the base 198 of the upper heel block 154.

The magnet 188 in the housing 182 draws and holds the magnetically attracted material 224 of the pull arm 170 to the magnet 188, and therefore the pull arm 170 and the stop 158 to and in the engaged position. In some embodiments, the position of the magnet 188 and the magnetically attracted material 224 is reversed so that the magnet is located in the pull arm 170 and the magnetically attracted material 224 is located in the housing 182.

To engage the key 38 of upper heel block 154 with the lower heel block 156 and to join the heel 160 to the upper heel block 154 (and shoe), the key and/or lower heel block 156 is/are positioned so that the forward portions 52, 62 are below the forward portions 90, 96 (or recesses 126, 128 in the case of key opening 81 used in heel block 156) of heel block 156. The key 38 and/or key opening 80 is/are further positioned so that the rearward portions 58, 64 are positioned below the recessed areas 130, 132 formed by the indents 94, 100 of the key opening 80 of the lower heel block 154. This also causes the portions at 104, 88 (or 118, 120 in the case of key opening 81 used in heel block 156) to be aligned with the spaces allowed by the indents 54, 60 of the key. Then the lower heel block 156 is moved upward in the direction L (FIG. 18) so that the key 38 is received in the key opening 80, the key and key opening having a position relative to each other that is the same or similar to that shown of the key and key opening in FIG. 10.

Then the lower heel block 156 and key opening 80 are moved, by the user, backward in the direction F (FIG. 18) to a locked or engaged position where there is a dove-tail engagement between the sidewall 66 of rearward portion 58 of the key 38 and side wall 102 of the rearward portion 98 of the lower heel block 156, and a dove-tail engagement between the sidewall 68 of the rearward portion 64 of the key 38 and the sidewall 104 of the rearward portion 92 of the key opening 80 in the lower heel block 154. There will also be a dove-tail engagement between the sidewall 66 of the forward portion 56 of the key 38 and the sidewall 102 of the forward portion 96, 120 of the lower heel block 156, and a dove-tail engagement between the sidewall 68 of the forward portion 62 of the key 38 and the sidewall 104 of the forward portion 90, 118 of the key opening 80 of the lower heel block 154. Further, the indents 54, 60 of the key 38 may be aligned with the respective indents 100, 94 of the heel block 156 when in the engaged position relative to the key opening, such as shown in FIG. 11 with key 38 and key recess 81.

When the key is in the engaged position relative to the key opening 80, the stop 158 moved to the engaged position shown in FIG. 19 into a stop home opening 32 (129 in the case key opening 81 is used in lower heel block 154) at the front of the key opening 80 and adjacent the front 72 of the key 38 to prevent all or substantial movement of the key 38 in the forward direction E (FIG. 18) and to keep the key 38 securely engaged with the lower heel block 156 and the lower heel block securely engaged with the upper heel block 154. The key 38, the stop 158, the key opening 80 in lower heel block 154 will each have a position relative to each other that is the same or similar to that shown of the key, the stop, and key opening in FIG. 11. The key 38 is secured against further rearward movement in the direction F by contact between the back end 48 of the key and the back wall 112 of the key opening 80.

When the stop 158 is moved to the released position shown in FIG. 20, the lower heel block 154 maybe be moved forward in the direction E until the key 38 is in the same position as shown in FIG. 10 regarding key 38 and key opening 81, and then the lower heel block 154 and the heel 160 may be moved downward in the direction M (FIG. 18) to remove the lower heel block 156 and the key opening 80 from the key 38 and to remove the heel 160 from the shoe 10.

In some embodiment, the heel blocks 14, 16, 154, 156, heel 144, the sole or heel block about the key opening 80, and key 38 can be made of a dense plastic, rubber, ABS or nylon type material, and/or metal, either cast or machined or combination of techniques. Metal could also be used. In some embodiment, all or a portion of the device 12, 140 152 and/or the sole 26 of the shoe 10 could be made using 3-D printer technology.

In some embodiments, the device 12, 140, 152 and the shoe 10 does not require the user to remove the shoe from his or her foot in order to detach and change heels, since the stop 18 is located conveniently on an outside surface of the shoe, on the vertical surface of the heel closest to the ball of the foot. The user can will push the stop to the released position toward the bottom of the heel, emptying the area that allows the key to disengage. The user can then bump the heel gently in the forward direction to disengage the key from the key opening and the heel is off. Reversing this procedure will install the desired heel to the shoe.

The device 12, 140, 152 can accomplish the purpose of great reliability and stability connecting the shoe heel to the shoe body, simply and economically. The great ease of engaging and disengaging this device 12, 140, 152 accomplishes the benefits of practicality of comfort, health and fashion versatility within modern lifestyle constraints. The device 12, 140, 152 allow detachable heels that can be interchangeably used with a shoe, such as the shoe 10.

Figure 2:
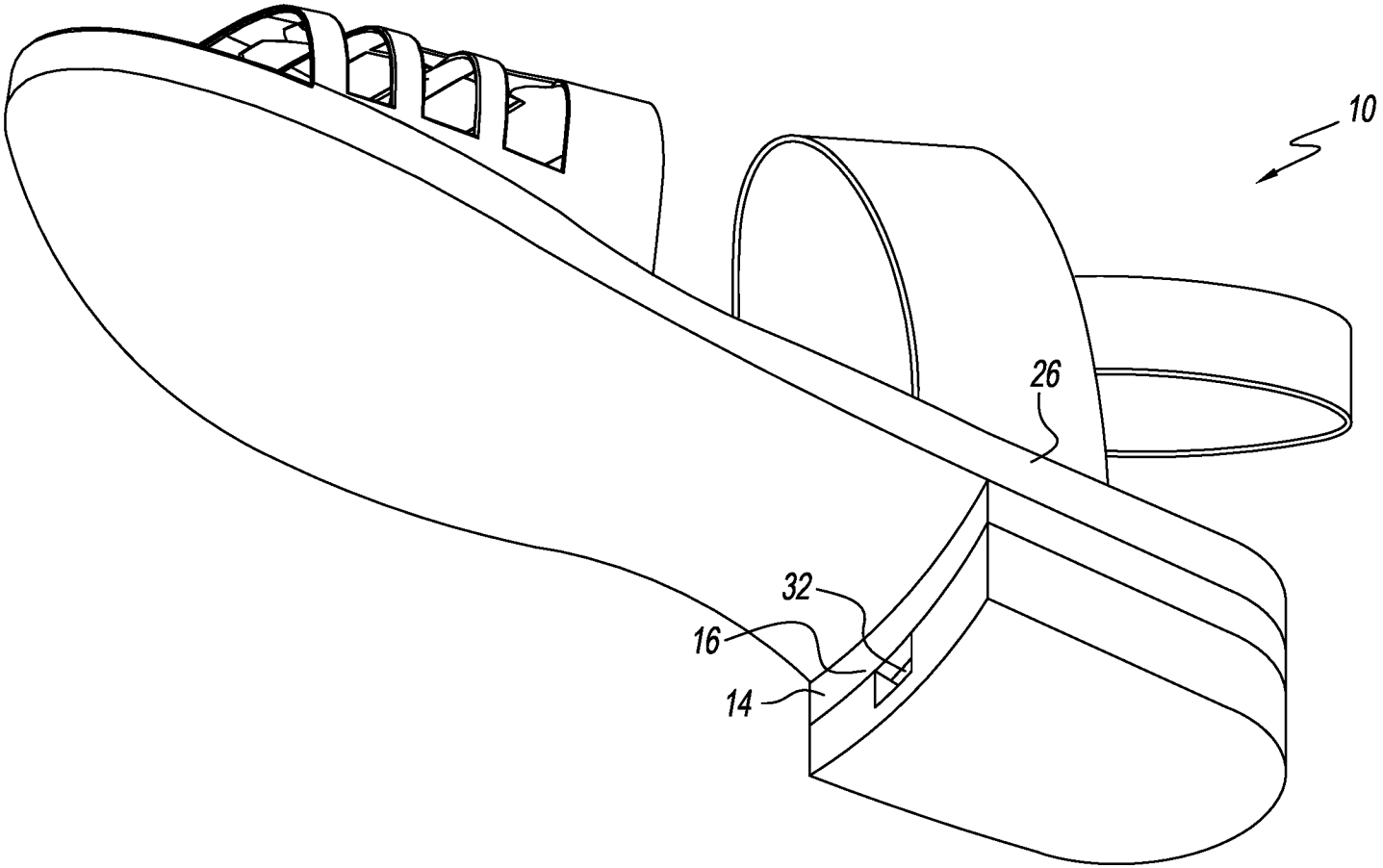
FIG. 2 is a bottom perspective view of the shoe and interchangeable heel device of FIG. 1.

While the shoe 10 of FIG. 2 is shown as an open toes sandal style shoe, but other styles of shoes, including close toed shoes and boots, may comprise the interchangeable heel device 12, 140, 152.

From the foregoing, it will be observed that numerous variations and modifications may be affected without departing from the spirit and scope of the invention. It is to be understood that no limitation with respect to the specific apparatus illustrated herein is intended or should be inferred. For example, one or more component embodiments may be combined, modified, removed, or supplemented to form further embodiments within the scope of the invention.

Further, steps could be added or removed from the processes described. Therefore, other embodiments and implementations are within the scope of the invention.

The invention claimed is:

1. An interchangeable heel device for a shoe, comprising:

a detectable heel for the shoe;

an upper heel block configured to be located in a heel area of a shoe below an insole of the shoe, the upper heel block comprising a key;

the heel comprising a receiving recess on an upper side of the heel, the key comprises a first key side opposite a second key side, the first and second key sides each comprise a key first engagement portion, a key second engagement portion, and a key non-engagement recess between the key first engagement portion and the key second engagement portion;

the receiving recess comprises a perimeter, the perimeter comprises a first receiving side opposite a second receiving side, the first and second receiving sides each comprise a receiving first engagement portion, and a receiving second engagement portion, and a receiving non-engagement recess between the receiving first engagement portion and the receiving second engagement portion, the key movable within the receiving recess between a released position and an engaged position, in the engaged position each key first engagement portion is engaged with one of the receiving first engagement portions and each key second engagement portions is engaged with one of the receiving second engagement portion to join the key to the perimeter and the heel to a sole of the shoe, in the released position each key first engagement portion is aligned with one of receiving non-engagement recesses and the key is removable from the receiving recess.

2. The device of claim 1, the first and second receiving sides each comprise a second receiving recess adjacent the receiving second engagement portion, wherein in the released position each key second engagement portion is aligned with one of the receiving second engagement portions and the key is removable from the receiving recess.

3. The device of claim 1, wherein the key first engagement portion of the first key side is converging with the key first engagement portion of the second key side in at least one first direction, wherein the receiving first engagement portion of the first receiving side is converging with the receiving first engagement portion of the second receiving side in at least one second direction.

4. The device of claim 1, wherein the key is friction fitted within the receiving recess when in the engaged position.

5. The device of claim 1, wherein a least a portion of the key is a tenon and a portion of the perimeter of the receiving recess is a mortise for receiving the tenon when the key is in the engaged position within the receiving recess.

6. The device of claim 1, wherein the key engages the receiving recess when in the engaged position to form a dove-tail engagement between the key and at least a portion of the perimeter of the receiving recess.

7. The device of claim 1, comprises a stop configured to engage the receiving recess and prevent the key from moving to the released position.

8. The device of claim 1, comprising a stop, the stop is mounted in the upper heel block, the stop is moveable between a stop engaged position adjacent the key and a retracted position above the key.

9. The device of claim 8, wherein the stop comprises a pull arm, a middle arm, and an engaging arm, the pull arm is pivotally connected to the middle arm, the middle arm is pivotally connected to the engaging arm.

10. The device of claim 1, wherein the heel is selected from the group consisting of a high heel and a low heel.

11. The device of claim 1, wherein the first and second key sides are angled and wherein the first and second receiving sides are complementary angled to the angle of the respective first and second key sides.

12. The device of claim 1, wherein the upper heel block is fixed to the shoe below the insole.

13. The device of claim 1, wherein the key comprises a wedge shape and the receiving recess comprises a wedge shape, wherein the key is friction fitted into the receiving recess when in the engaged position.

14. A shoe having an interchangeable heel, comprising:

a sole;

a key in a heel area of the shoe below an insole of the sole;

a heel comprising a receiving recess on a top side of the heel configured to engage the key;

the key comprises a first key side opposite a second key side, the first and second key sides each comprise a key first engagement portion and a key second engagement portion and a key recessed region between the key first engagement portion and the key second engagement portion;

the receiving recess comprises a perimeter, the perimeter comprises a first receiving side opposite a second receiving side, the first and second receiving sides each comprise a receiving first engagement portion and a receiving second engagement portion and a receiving non-engagement recess between the receiving first engagement portion and the receiving second engagement portion; and, the key movable within the receiving recess between an released position and an engaged position, in the engaged position each key first engagement portion is engaged with one of the receiving first engagement portions and each key second engagement portions is engaged with one of the receiving second engagement portion to join the key to the perimeter and the heel to the sole, in the released position each key first engagement portion is aligned with one of receiving non-engagement recesses and the key is removable from the receiving recess.

15. The shoe of claim 14, the first and second receiving sides each comprise a second receiving recess adjacent the receiving second engagement portion, wherein in the released position each key second engagement portion is aligned with one of the receiving second engagement portions and the key is removable from the receiving recess.

16. The shoe of claim 14, wherein the key first engagement portion of the first key side is converging with the key first engagement portion of the second key side in at least one first direction, wherein the receiving first engagement portion of the first receiving side is converging with the receiving first engagement portion of the second receiving side in at least one second direction.

17. The shoe of claim 14, wherein the key is friction fitted within the receiving recess when in the engaged position.

18. The shoe of claim 14, wherein a least a portion of the key is a tenon and a portion of the perimeter of the receiving recess is a mortise for receiving the tenon when the key is in the engaged position within the receiving recess.

19. The shoe of claim 14, wherein the key engages the receiving recess when in the engaged position for form a dove-tail engagement between the key and at least a portion of the perimeter of the receiving recess.

20. The shoe of claim 14, comprising a stop configured to engage the key and prevent the key from moving to the released position.

21. The shoe of claim 20, comprising a spring to bias the stop to a blocking position preventing the key from moving to the released position.

22. The shoe of claim 14, wherein the heel is selected from the group consisting of a high heel and a low heel.

23. The shoe of claim 14, wherein the first and second key sides are angled and wherein the first and second receiving sides are complementary angled to the angle of the respective first and second key sides.

24. The device of claim 14, comprising an upper heel block, the upper heel block comprising the key, the upper heel block fixed to the shoe below the insole.

25. The shoe of claim 24, comprising a lower heel block, the key extends above a base of the lower heel block, the lower heel block is fixed to the heel.

26. The device of claim 14, wherein the key comprises a wedge shape and the receiving recess comprises a wedge shape, wherein the key is friction fitted into the receiving recess when in the engaged position.

27. A method of changing a heel of a shoe, comprising the steps of:

withdrawing a key of a shoe from an engaged position to a released position within a receiving recess of a first heel where a opposite key first engagement portions and a opposite key second engagement portions of the key are disengaged from respective opposite recess first engagement portions and opposite recess second engagement portions a perimeter of the receiving recess;

removing the first heel from the shoe by aligning the opposite key first engagement portion with opposite receiving non-engagement recesses of the receiving recess and moving the receiving recess in a direction away from the key, wherein the opposite receiving non-engagement recesses are located between the opposite recess first and second engagement portions of the perimeter;

inserting the key into a receiving recess of a second heel; and moving the second heel to cause the receiving recess of the second heel to move to an engaged position where opposite key first engagement portions and opposite key second engagement portions of the key of the second heel are engaged with respective opposite recess first engagement portions and opposite recess second engagement portions a perimeter of the receiving recess of the second heel.

* * * * *